US006136206A

United States Patent [19]

Butcher et al.

[11] Patent Number: 6,136,206

[45] Date of Patent: Oct. 24, 2000

[54] SWIMMING POOL SKIMMER CLEANER

[76] Inventors: Greg Butcher, 9619 Winsome, Houston, Tex. 77063; Randy Smith, P.O. Box 752104, Houston, Tex. 77275-2104

[21] Appl. No.: 09/458,526

[22] Filed: Dec. 13, 1999

Related U.S. Application Data

[62] Division of application No. 09/178,807, Oct. 26, 1998, Pat. No. 6,029,290.

[51] Int. Cl.[7] ..... B01D 35/16; E04H 4/16

[52] U.S. Cl. ..... 210/776; 210/169; 4/512

[58] Field of Search ..... 210/776, 154, 210/162, 169; 4/496, 510, 512

[56] References Cited

U.S. PATENT DOCUMENTS

| | | | |
|---|---|---|---|
| 3,976,573 | 8/1976 | Miller | 210/158 |
| 4,904,379 | 2/1990 | Ward | 210/169 |
| 5,061,380 | 10/1991 | Stevenson | 210/154 |
| 5,110,461 | 5/1992 | Abel | 210/158 |
| 5,573,660 | 11/1996 | Eicker et al. | 210/159 |
| 5,641,398 | 6/1997 | Huber et al. | 210/158 |
| 5,798,038 | 8/1998 | Huber | 210/154 |
| 5,862,541 | 1/1999 | Mailhot | 210/169 |
| 6,029,290 | 2/2000 | Butcher et al. | 210/169 |

*Primary Examiner*—Robert J. Popovics
*Attorney, Agent, or Firm*—Winstead Sechrest & Minick; Timothy M. Donoughue; Robert C. Shaddox

[57] ABSTRACT

An invention utilizing a screw to remove debris from a swimming pool filtration system skimmer and deposit it into a waste receptacle. The lower end of the axis of the screw is inserted into the skimmer below the level of the water. As the screw is reotated, it removes debris from the skimmer to a point outside the skimmer where the screw deposits it into a receptacle.

12 Claims, 4 Drawing Sheets

SWIMMING POOL SKIMMER CLEANER

This is a divisional of United States patent application Ser. No. 09/178,807, filed Oct. 26, 1998 now U.S. Pat. No. 6,029,290.

BACKGROUND OF THE INVENTION

Swimming pools have long been filtered. The filter system on a swimming pool consists of one or more inlets, a pump, and one or more outlets. As the pools are open to the environment, they are subject to contamination by a variety of items of a variety of sizes. In order to trap the larger items which may fall into the pool, including leaves, larger bugs, etc., the inlets to the pump are equipped with a device called a skimmer.

A swimming pool skimmer is essentially a cavity containing a basket. Water enters the skimmer from the pool at the side of the cavity, above the basket. Water exits the skimmer at the bottom of the cavity, below the basket. Debris from the pool follows the water into the skimmer and is trapped in the basket.

DESCRIPTION OF THE PRIOR ART

Conventionally, the skimmer baskets require frequent cleaning. The basket must be physically removed from the skimmer by lifting it from the skimmer. The debris must be disposed of and the basket replaced. Failure to clean the skimmer can lead to a blockage in the filtration system that puts undue burden on the pump. Such cleaning represents an inconvenience not only for the frequency with which it must be done, but because of the location of the skimmer, which is at water level. A pool owner must stoop to get the basket.

Several inventions have been developed to assist in the cleaning of skimmer baskets. Most commonly, people have addressed the skimmer problem by developing hooked sticks suitable for removing the cover from the skimmer and retrieving the basket. Using these inventions, a pool owner may perform these maintenance tasks from a standing position. While such inventions make the task of cleaning the skimmer basket more simple, there remains a need to automate the process. No invention to date relieves the pool owner of the responsibility of constantly giving attention to the skimmer basket.

SUMMARY

The present invention solves the problems associated with cleaning the skimmer basket on swimming pools by providing an automated and automatic process whereby the skimmer is continually cleaned. The invention utilizes a screw to remove debris from the skimmer and deposit it into a waste receptacle. Accordingly, the skimmer is maintained in a clean state, requiring much less attention. Also as a result, filtration pump life on the pool is enhanced due to decreased instances of clogging. Finally, debris is removed from the pool in a timely manner, providing a cleaner pool environment.

The invention is comprised of an apparatus for use with a filtration system of a swimming pool comprising one or more screws positioned within an enclosure, said enclosure within a skimmer beneath the water level and extending therefrom to a point outside of the skimmer; and a driving mechanism mechanically connected to the screw and capable of moving the screw in a rotational direction so as to lift debris from the water to the outside of the skimmer. The apparatus may include one or more screws composed of a material through which water may not flow. The apparatus may be attachable to said filtration system. The apparatus may be adjoinable to said filtration system. The apparatus may be adjoinable to said filtration system by placement within the skimmer of the filtration system. The invention may further comprise a receptacle positionable below said top axis, said receptacle having a top end which is capable of accepting falling material from said screw into said receptacle. The driving mechanism may comprise an electric motor, an internal combustion engine, or a turbine driven by water passing through the apparatus.

Further, the invention is a method for maintaining a skimmer of a swimming pool filtration system comprising the steps of disposing one or more screws within a filtration system so as to be partially submerged in the water of a swimming pool; and rotating the one or more screws in such a manner as to lift one or more articles of debris from the water and deposit it outside the filtration system and outside the swimming pool. The invention may include the step of collecting said one or more articles of debris in a receptacle. The invention may comprise the following additional steps: positioning the one or more screws having an axis, the top of said axis being disposed outside the filtration system and outside the swimming pool, and the bottom of said axis being disposed underneath the water.

DETAILED DESCRIPTION OF THE PREFERRED EMBODIMENT

Figure 1:
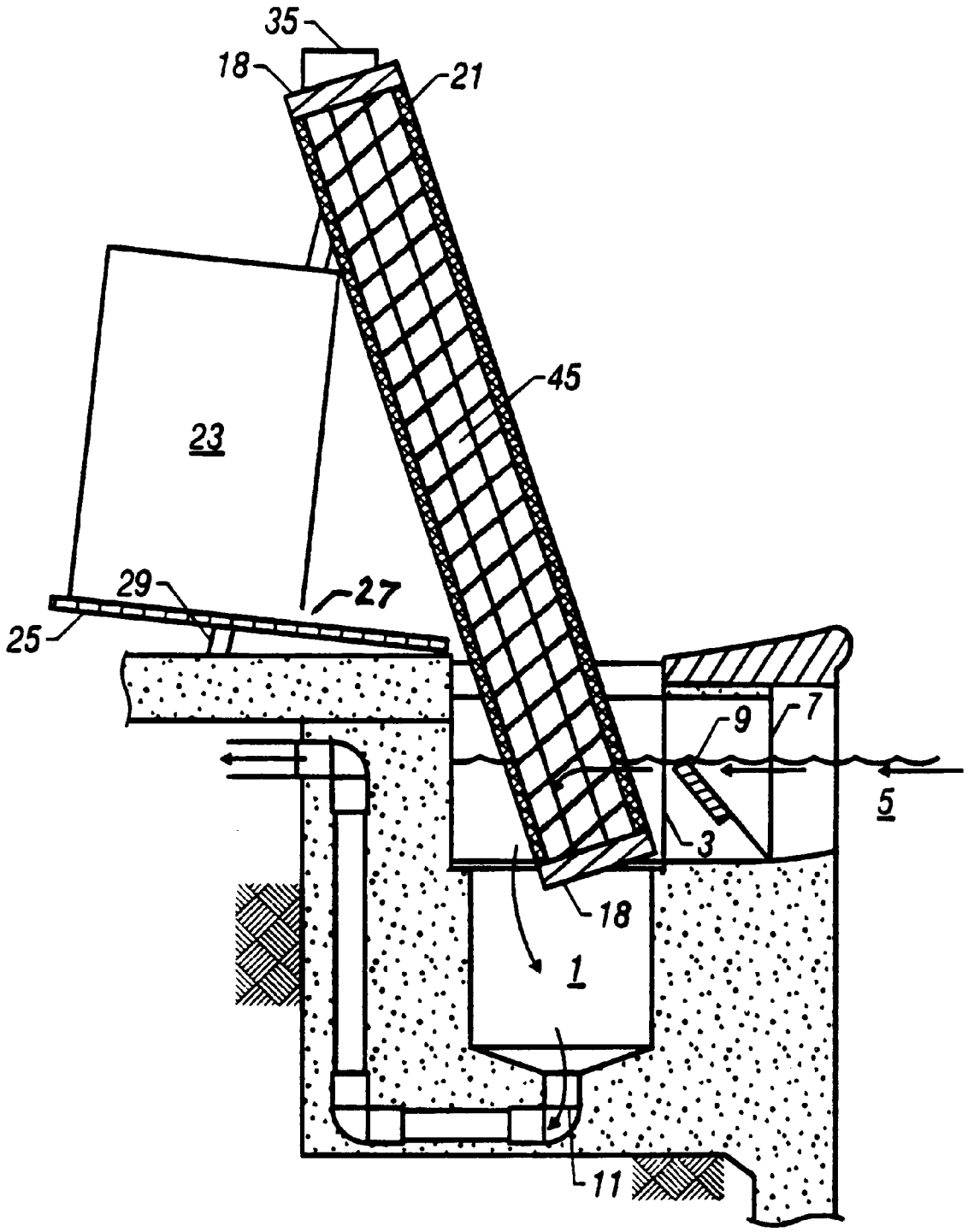
FIG. 1 is a cross-sectional view of the present invention as viewed from the side.
Figure 2:
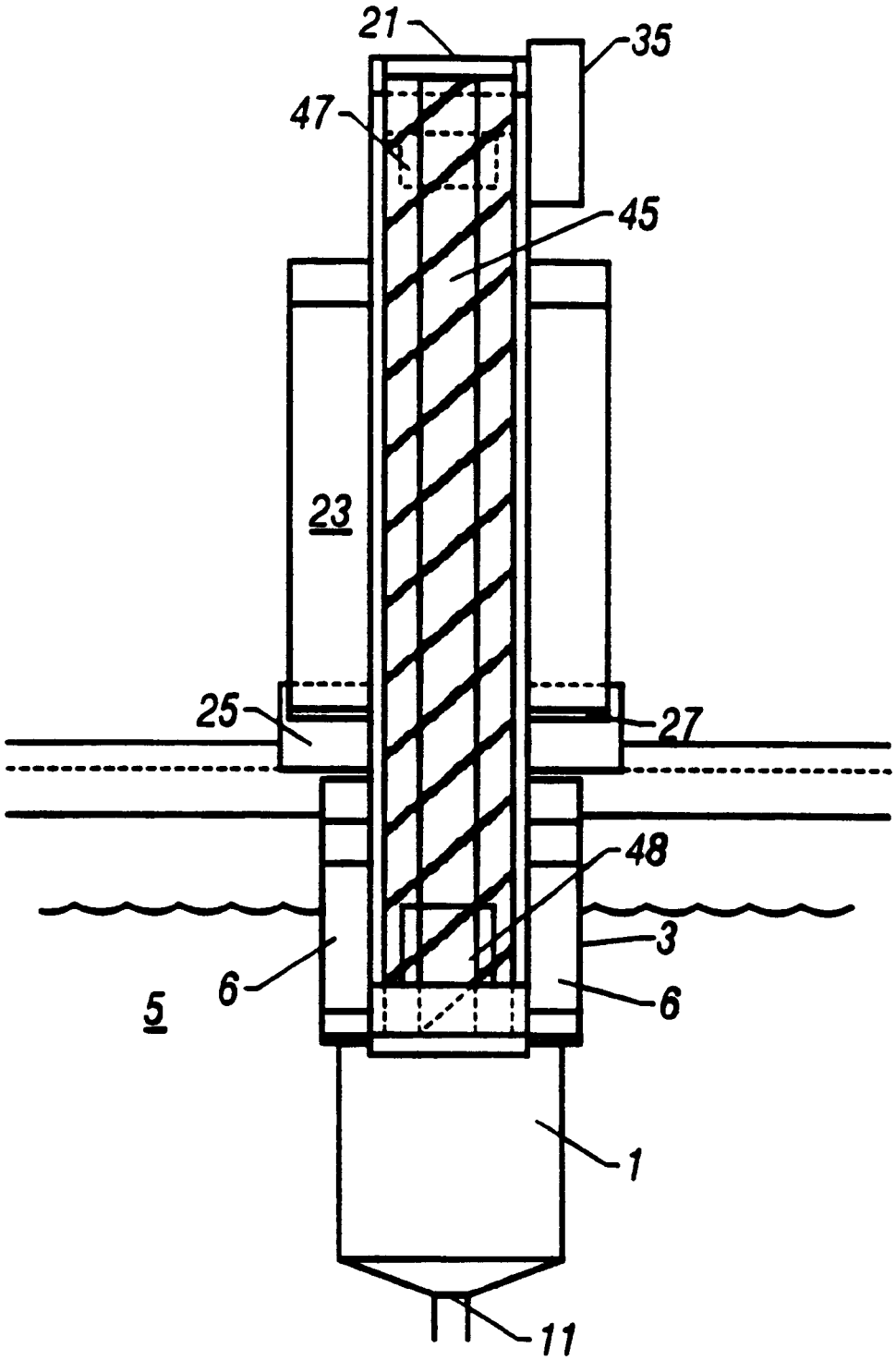
FIG. 2 is a cross-sectional view from the front of the present invention.

Referring to FIGS. 1 and 2, a swimming pool skimmer 1, having an upper skimmer 3, is located at the edge of a swimming pool. The upper skimmer 3 is located vertically at such a height as to intercept the level of water 5 within the pool. The water 5 may enter an opening 7 in the upper skimmer 3, passing over a flow control door 9. Once in the upper skimmer 3, the water 5 may flow through the bottom portion of an enclosure 21, which can be situated to rest inside the upper skimmer 3. A flap 6 on either side of the enclosure 21 forces the water 5 to pass through the cleaner 17. The water 5 may then continue through the bottom of the upper skimmer 3 into the skimmer 1. From the skimmer 1, the water 5 may pass via a pipe 11 into a normal filtration system.

The cleaner 17 is composed of enclosure 21 and a screw 45, which is placed within enclosure 21 and is rotatable about its axis. The top of the axis of screw 45 is disposed outside the filtration system and outside the swimming pool, whereas the bottom of the axis of screw 45 is disposed underneath the water 5. The screw 45 is composed generally of any material through which water may not flow. The screw 45 is driven by a motor 35 such that debris entering the enclosure 21 through a lower portal 48 is passed up the enclosure 21 to an upper portal 47. Debris exiting the upper portal 47 then falls by operation of gravity into a receptacle 23.

The motor 35 can be an electric motor powered by normal house current, but need not be. It can be powered by solar electrical power, electric battery, internal combustion engine, or other means which will produce a rotational power to drive the screw 45.

The enclosure 21 can be positioned at an angle to the upper skimmer 3 So that the top portion of the enclosure 21 extends beyond the edge of the upper skimmer 3 in a horizontal direction away from the water 5 and the opening 7. A receptacle 23 may then be positioned below the top end of the cleaner 17. As debris is carried up screw 45 and over its top, the debris then falls by operation of gravity into the receptacle 23.

In the preferred embodiment, the receptacle 23 is positioned at an angle to the horizontal upon a platform 25. The platform 25 can rest upon the ground and upon a support 29 in order to insure that an angle to the horizontal is maintained. An opening 27 in the bottom of the receptacle 23 on the lower corner of the receptacle serves to allow water 5 carried into the receptacle 23 to drain back into the upper skimmer 3. The opening 27 must be wide enough to permit the water 5 to escape, but must be narrow enough to disallow debris in the receptacle 23 from reentering the upper skimmer 3. While it is preferred that the opening 27 extend the width of the receptacle 23, the opening 27 may be composed of one or more apertures of a configuration to achieve the ends described.

In an alternative embodiment, the motor 35 may be connected to the bottom of screw 45. Such a configuration has the advantage of a less top-heavy apparatus, but has the disadvantage of requiring a waterproof motor.

Figure 3:
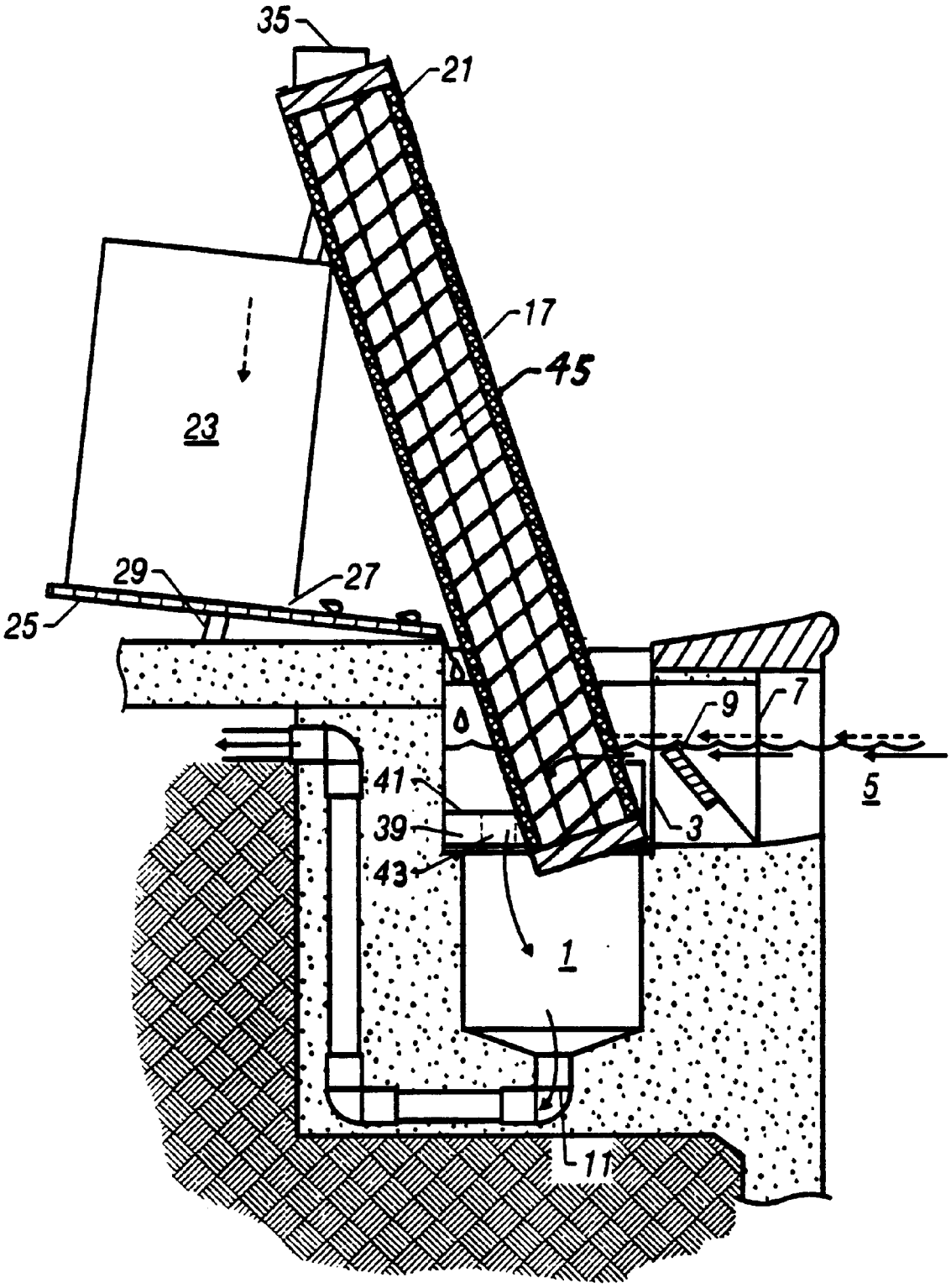
FIG. 3 is a cross-sectional view of the hydraulically-driven embodiment of the present invention as viewed from the side.
Figure 4:
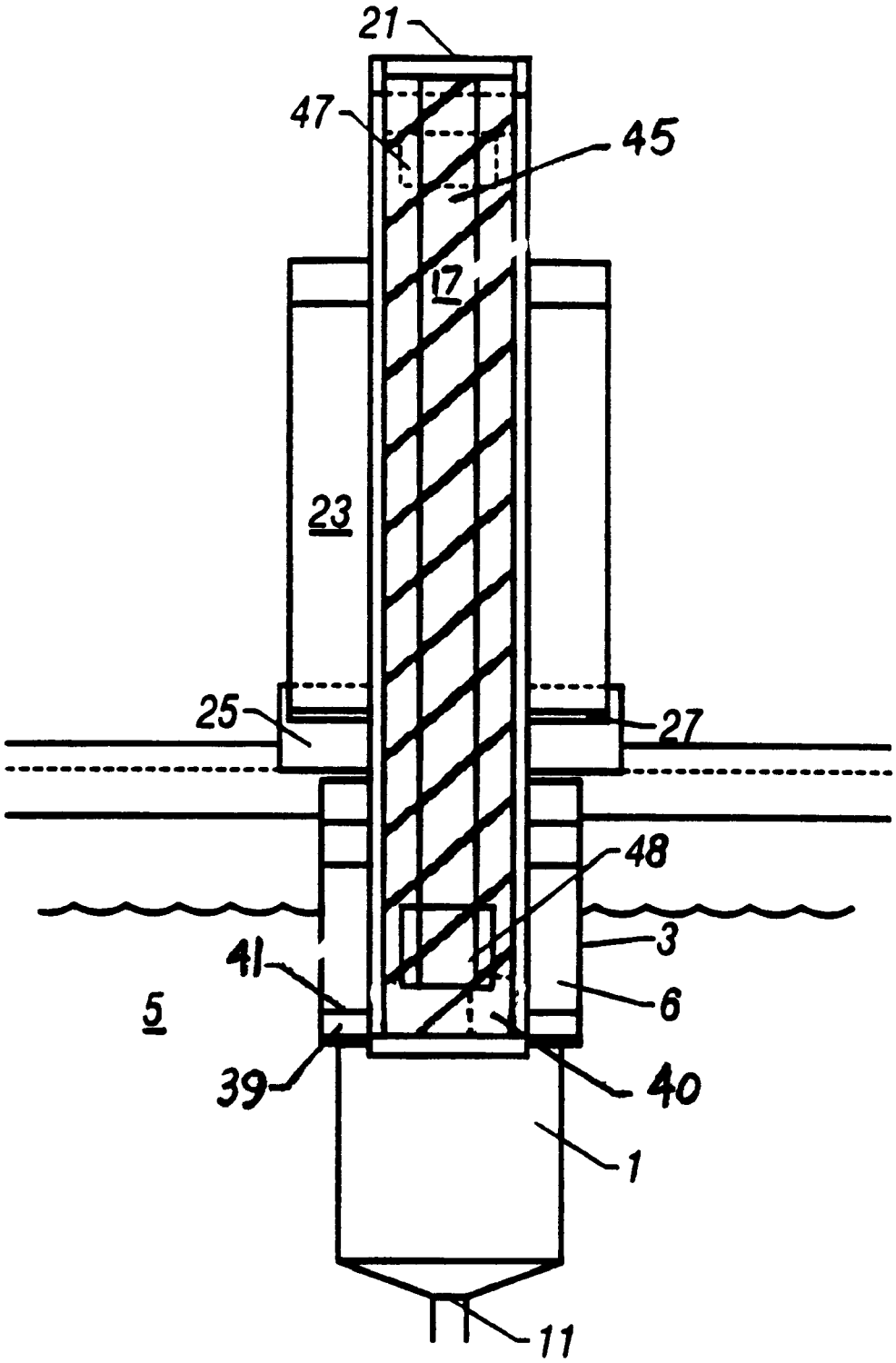
FIG. 4 is a cross-sectional view of the hydraulically-driven embodiment of the present invention as viewed from the front.

As illustrated in FIGS. 3 and 4, the motor 35 may be omitted and replaced by a turbine 39. The turbine 39 is drivable by the hydraulic action of the water 5 as it flows through the opening 7, through the upper skimmer 3, and through the skimmer 1. A plate 41 precludes the flow of the water 5 except through one or more turbine apertures 43. The turbine 39 in turn drives a gear box 40, which in turn drives the screw 45. This embodiment has the advantages of the operation of the invention without the need for an additional power source of any sort.

As to the manner of operation and use of the present invention, the same is made apparent from the foregoing discussion. With respect to the above description, it is to be realized that although dimensional embodiments of specific material is disclosed, those enabling embodiments are illustrative, and the optimum dimension relationships for the parts of the invention are to include variations in composition, form, function and manner of operation, assembly and use, which are deemed readily apparent to one skilled in the art in view of this disclosure, and all equivalent relationships to those illustrated in the drawings and encompassed in the specifications are intended to be encompassed by the present invention.

Therefore, the foregoing is considered as illustrative of the principles of the invention and since numerous modifications will readily occur to those skilled in the art, it is not desired to limit the invention to the exact construction and operation shown or described, and all suitable modifications and equivalents may be resorted to, falling within the scope of the invention.

What is claimed is:

1. An apparatus for use with a filtration system of a swimming pool having water therein, said apparatus comprising:

at least one screw positioned within an enclosure, said enclosure being within a skimmer of a swimming pool beneath the water level and extending therefrom to a point outside of the skimmer; and a driving mechanism mechanically connected to said screw and capable of moving said screw in a rotational direction so as to lift debris from the water to the outside of the skimmer.

2. The apparatus described in claim 1 wherein said at least one screw is composed of a material through which water may not flow.

3. The apparatus described in claim 1 wherein the apparatus is attachable to said filtration system.

4. The apparatus described in claim 1 wherein the apparatus is adjoinable to said filtration system.

5. The apparatus of claim 4 wherein the apparatus is adjoinable to said filtration system by placement within the skimmer of the filtration system.

6. The apparatus described in claim 1 further comprising a receptacle positionable below the top of said screw, said receptacle having a top end which is capable of accepting falling material from said screw into said receptacle.

7. The apparatus described in claim 1 wherein said driving mechanism comprises an electric motor.

8. The apparatus described in claim 1 wherein said driving mechanism comprises an internal combustion engine.

9. The apparatus described in claim 1 wherein said driving mechanism comprises a turbine driven by water passing through the apparatus.

10. A method for maintaining a skimmer of a swimming pool filtration system comprising the steps of:

disposing at least one screw within a filtration system so as to be partially submerged in the water of a swimming pool; and rotating said at least one screw in such a manner as to lift debris from the water within said skimmer and deposit it outside the filtration system and outside the swimming pool.

11. The method described in claim 10 further comprising the step of collecting said debris in a receptacle.

12. The method of claim 10 comprising the following additional steps:

positioning at least one screw along an axis, the top of said axis being disposed outside the filtration system and outside the swimming pool, the bottom of said axis being disposed underneath the water.

* * * * *